US005836794A

United States Patent [19]

Krueger

[11] Patent Number: 5,836,794

[45] Date of Patent: Nov. 17, 1998

[54] RETRACTABLE TROLLING MOTOR HOUSING FOR BOAT

[75] Inventor: William R. Krueger, New Berlin, Wis.

[73] Assignee: Outboard Marine Corporation, Waukegan, Ill.

[21] Appl. No.: 941,493

[22] Filed: Sep. 30, 1997

[51] Int. Cl.[6] ..... B63H 5/12

[52] U.S. Cl. ..... 440/54; 440/49

[58] Field of Search ..... 440/6, 7, 49, 54

[56] References Cited

U.S. PATENT DOCUMENTS 5,125,858 6/1992 Salvetti ..... 440/54

*Primary Examiner*—Jesus D. Sotelo

*Attorney, Agent, or Firm*—Jones, Day, Reavis & Pogue

[57] ABSTRACT

A motor boat having a retractable trolling motor which motor is surrounded by a housing. The housing includes a top wall, two side walls and a bottom wall with openings at the front and rear of the housing to allow water to be pumped through the housing as if it were a tunnel. The housing is rotatable through 360 degrees and is simple, easy to used and reliable. The housing has a bottom surface which is shaped to be a continuation of the bottom surface of the boat so as not to interfere with the handling or performance of the boat or even the appearance of the boat. The retracted housing is unobtrusive and provides protection for the propeller against weeds and debris.

14 Claims, 4 Drawing Sheets

RETRACTABLE TROLLING MOTOR HOUSING FOR BOAT

BACKGROUND OF THE INVENTION

1. Field of the Invention

The present invention relates to a trolling motor housing and, more particularly, to a retractable trolling motor housing for a fishing boat which is simple, reliable and economical.

2. Description of the Related Art

Trolling motors are typically used on power boats, sometimes called bass boats, as a secondary source of power to keep a boat's position stationary, to make fine adjustments to the boat's position and to move the boat slowly in a predetermined manner decided upon by the operator/fishing person. Often there is wind which tends to push the boat away from a specific desired position, or the current around a boat tends to move the boat away from a desired spot. In both cases, a trolling motor helps maintain a boat's desired position. A trolling motor also allows an operator to move into more shallow water than is possible with a power boat's main motor, to make tighter turns and to move from one spot to another spot in the same area in a very quiet manner.

Many boats have a detachable trolling motor which is placed on the boat's deck when the boat is being moved by its primary source of power, usually an outboard internal combustion engine such as those sold under the Evinrude and Johnson brands. When a fishing area is reached the trolling motor is placed in the water and attached to the bow portion of the boat and the trolling motor powers the boat instead of the main motor.

Some related prior patents show trolling motors fixed to a boat and even show that they are retractable. For example, U.S. Pat. Nos. 4,529,386 and 4,668,195 illustrate retractable trolling motors where the device includes trap doors in the bottom of the boat hull. U.S. Pat. Nos. 4,734,066 and 4,728,301 also illustrate retractable trolling motors. However, when the motor retracts, it does so into a cavity in the hull, but there is no covering element. Another retractable trolling motor is shown in U.S. Pat. No. 3,685,481. Again, there is no covering to a cavity in the hull where the trolling motor is stored when it is retracted. Still another example of a retractable trolling motor is seen in U.S. Pat. No. 3,587,512.

None of these designs have proven optimal. They are either too complicated and thereby too expensive, or they are not reliable, or they interfere with the operation of the boat.

BRIEF DESCRIPTION OF THE INVENTION

The difficulties encountered by previous devices have been overcome by the present invention. What is described here is a retractable housing apparatus for a boat trolling motor comprising a bottom wall with a streamline surface, first and second side walls connected to the bottom wall, an upstream opening for the passage of water, a downstream opening for the passage of water that enters through the upstream opening, and a chamber formed above the bottom wall and between the side walls.

The invention also includes a trolling motor apparatus for use with a boat comprising in combination a boat having a hull with a bottom surface, a main motor connected to the boat for powering the boat, a trolling motor mounted to the boat, a housing formed around the trolling motor, the housing including a bottom surface, means connected to the housing and the boat for moving the housing between upward and downward positions relative to the hull; an electrical energy source mounted to the boat, means connected to the energy source and the trolling motor for transmitting power to the trolling motor when the housing is in a downward position, means connected to the energy source and the moving means for transmitting power to the moving means, means connected to the trolling motor for steering the boat; and a recess in the bottom of the boat to receive the housing.

An object of the present invention is to provide a retractable trolling motor housing for a boat that is simple, easy to use and reliable. Another aspect of the present invention is to provide a retractable trolling motor housing that is economical and efficient. Still another advantage of the present invention is to provide a retractable trolling motor housing that does not interfere with handling of the boat or the boat's performance when the trolling motor is not deployed. Still another aim of the present invention is to provide a retractable trolling motor housing that provides for a strong mounting for trolling motors, is unobtrusive and provides for propeller protection from weeds, debris and the like.

A more complete understanding of the present invention and other objects, aspects, aims and advantages thereof will be gained from a consideration of the following description of the preferred embodiments read in conjunction with the accompanying drawings provided herein.

DESCRIPTION OF THE PREFERRED EMBODIMENTS

Figure 1:
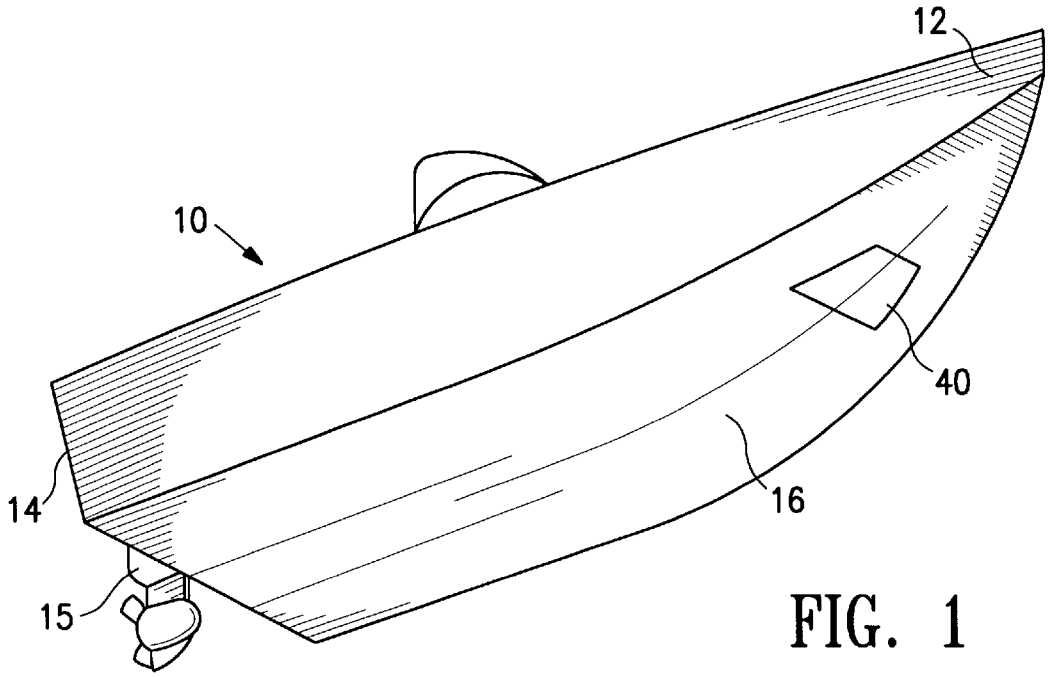
FIG. 1 is a bottom perspective view of a boat having a retractable trolling motor of the present invention.

While the present invention is open to various modifications and alternative constructions, the preferred embodiments as shown in the drawings will be described in detail below. It is to be understood, however, that there is no intention to limit the invention to the particular forms disclosed. On the contrary, the intention is to cover all modifications, equivalent structures or methods and alternative constructions falling within the spirit and scope of the invention as expressed in the appended claims.

Figure 2:
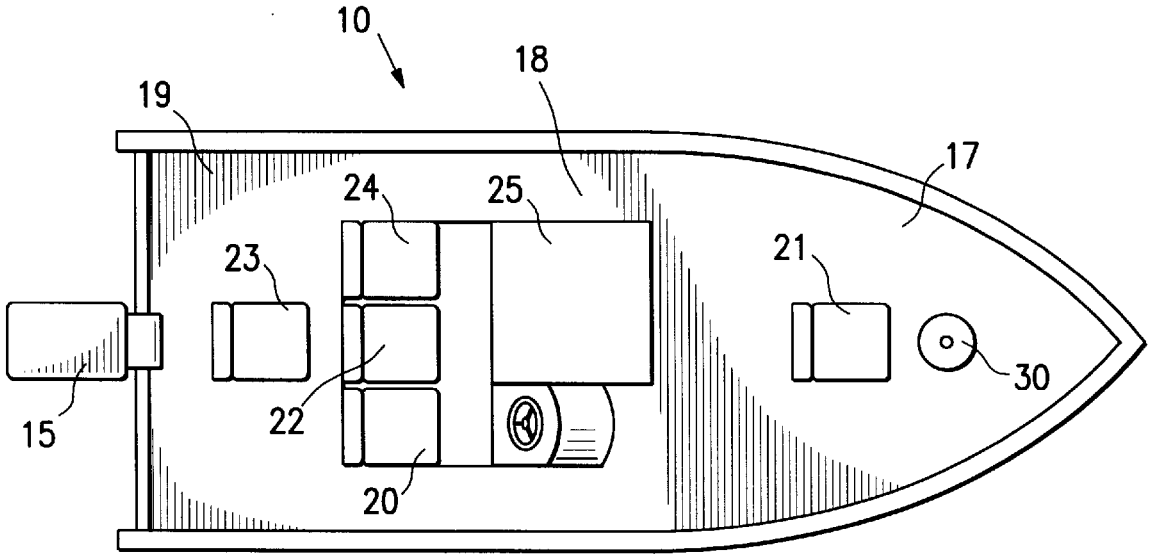
FIG. 2 is a top plan diagrammatic view of the boat shown in FIG. 1.
Figure 3:
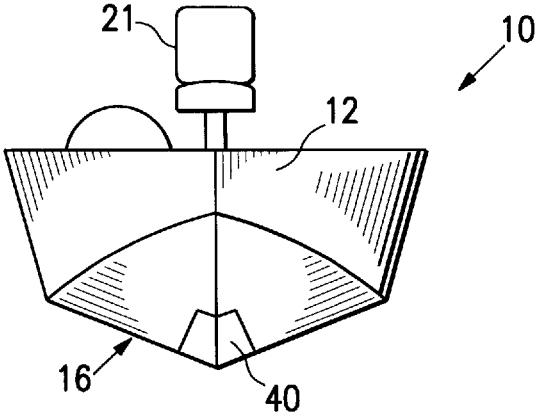
FIG. 3 is a front elevational view of the boat of FIG. 1.

Referring now to FIGS. 1, 2 and 3, the unobtrusiveness of the trolling is immediately apparent. Also to be appreciated is that the trolling motor will not interfere with the handling of the boat, with the boat's performance nor with the fishing person. Shown in three different views is a fishing or "bass"

boat 10 having a bow 12, a stern 14, a hull 16 and a deck 18. Attached to the stern is an internal combustion outboard engine 15. This engine is the main motor for the boat. The boat also includes a bow casting deck 17, a stern casting deck 19, fore and aft pedestal chairs 21 and 23, a driver's seat 20 and two passenger seats 22 and 24. A helm console 25 with instruments is also provided. Fishing boats of the type described are available from Lowe Aluminum Boats of Lebanon, Mo., bearing the model designation 18EX. Such a boat usually includes a 90–175 horsepower Johnson or Evinrude brand outboard and an Evinrude or Johnson brand foot controlled trolling motor. The trolling motor typically uses 24 volts and has 56 pounds of thrust.

Fishing boats generally are operated in one of two modes. First, the boat may be operated in a motorboat fashion where power comes from the outboard motor 15. This engine is used to move the boat quickly from a dock or shore location to a fishing area, and from one area to another and back to the dock. Second, the boat may be operated in its trolling mode. In this mode, a trolling motor system is used to move the boat from one "spot" to another in a particular area, to maintain position against wind and current, to make fine position changes, to make tight turns or to move in water too shallow for the main motor. Typically, a trolling motor system comprises an electric motor connected to a steering mechanism and to an energy source, such as a battery.

Operating the boat in one of the two modes mentioned, as a motor boat or as a trolling boat, require hardware which are inconsistent with the most efficacious use of the other mode. For example, the presence of a trolling motor, either attached to the side of the boat or in some other location, or even trolling motors that are retractable, generally generate drag on the boat and thus degrade the performance that the operator would normally expect from the boat's main, outboard engine.

Figure 4:
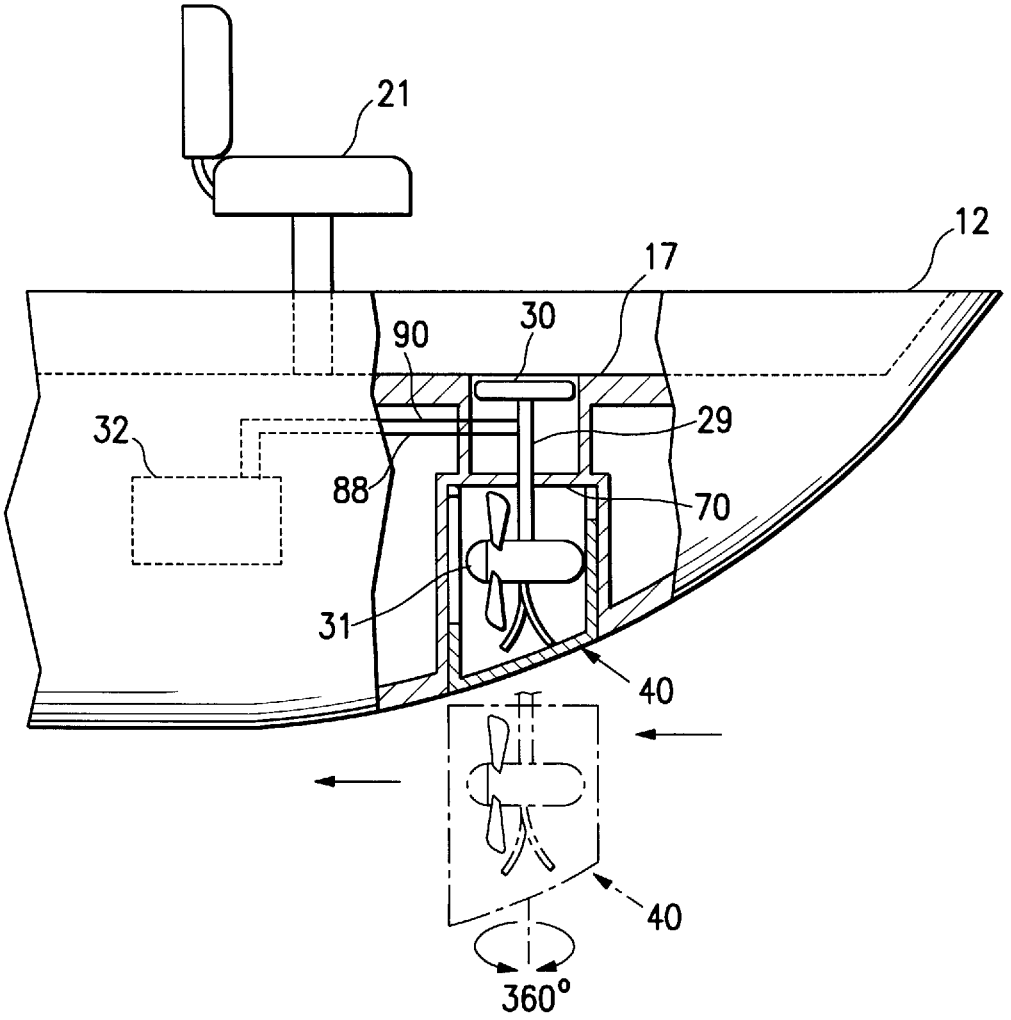
FIG. 4 is a diagrammatic, partial side elevational view, partially broken away of the boat of FIG. 1.
Figure 5:
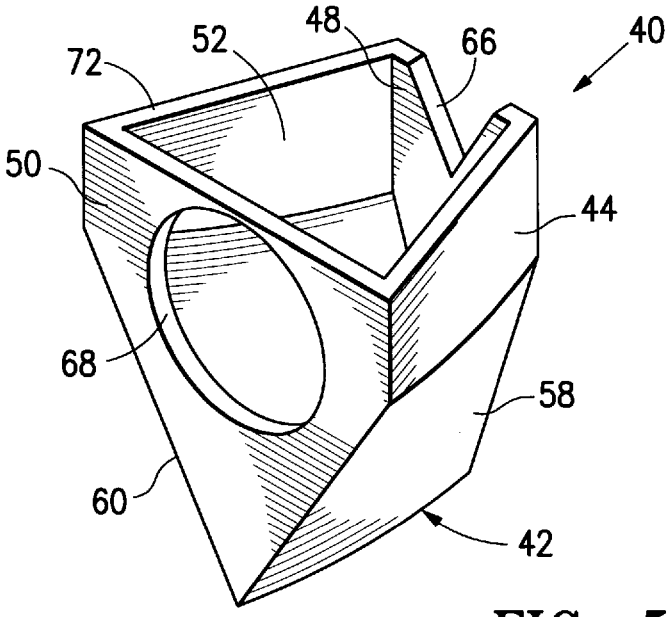
FIG. 5 is a top perspective view of the trolling motor housing of the present invention.
Figure 6:
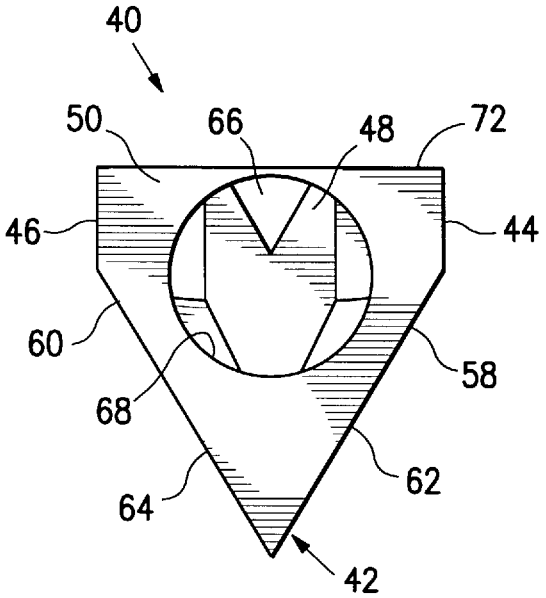
FIG. 6 is a rear elevational view of the trolling motor housing of the present invention.

Returning to FIGS. 1, 2 and 3 and also referring to FIG. 4, the trolling motor system is comprised of a housing 40, a support shaft 29 and a steering disc 30. The system is mounted in the bow of the boat and includes a trolling motor 31 connected to the housing. The housing is movable upwardly and downwardly by a suitable mechanism that receives electrical power from a battery 32 mounted in the boat. The battery may also be the source of energy for the trolling motor. In FIG. 4, the housing/trolling motor combination is shown in a retracted position in solid line. In this mode the trolling motor is in storage. However, in phantom line, the housing and trolling motor combination is extended beneath the boat where the trolling motor may power the boat in its usual manner.

The trolling motor may rotate through an arc of 360 degrees since there is no obstruction. By being located on the longitudinal center line of the boat, it is in its most effective position. The steering disc 30 may be operated by a fishing person, in a well-known manner. Indeed, a fishing person seating in the pedestal chair 21 or standing on the bow casting deck is able to operate the steering mechanism with his/her foot. The steering disc may also have a throttle mechanism which allows the operator to rotate the trolling motor and to increase or decrease the power to the motor. In this way, the fisherman is able to move the boat in any desired direction and at any desired velocity within the limits of the trolling motor.

The advantages of simplicity and reliability may be seen by referring now to the trolling motor housing 40, shown in FIGS. 5–8. The trolling motor housing is comprised of a bottom wall 42, a first side wall 44, an opposite side wall 46, a front wall 48 and a rear wall 50. Within a chamber 52, formed by the walls, is a trolling motor 54 having propeller blades, such as the blade 56. The bottom wall comprises two portions 58 and 60 which form a generally V-shape in cross-section. The outer surfaces 62 and 64 of the two portions are streamlined and, in particular, are continuations of the bottom surfaces of the hull 16. When the housing is in its retracted or upward position, the housing bottom wall is flush or aligned with the hull of the boat. Hence, when the boat is powered by its main outboard engine 15 there is no degradation of boat performance.

Formed in the front wall is an opening 66 having a generally triangular shape. Formed in the rear wall is another opening 68 having a circular shape. The two openings allow water surrounding the boat to be pumped past the trolling motor. Water enters through the front opening 66 and exits through the rear opening 68, thereby creating somewhat of a tunnel effect. The tunnel effect increases the efficiency of the trolling motor by providing more thrust for a given power rating. The tunnel also tends to protect the trolling motor propeller from weeds and other debris.

The housing 40 nests in a recess 70, FIG. 4, in the hull of the boat when retracted. The dimensions and shape of the recess is defined by and complements the front, rear and side walls of the housing and the upper ledge 72 formed by the front, rear and side walls. The recess is enclosed and is essentially water tight. It should be noted that when the boat is in normal plane, the region of the hull having the retractable housing is out of the water; this also helps to insure no interference with performance at high velocity. Also the streamline appearance of the boat is maintained from an aesthetic standpoint.

Figure 8:
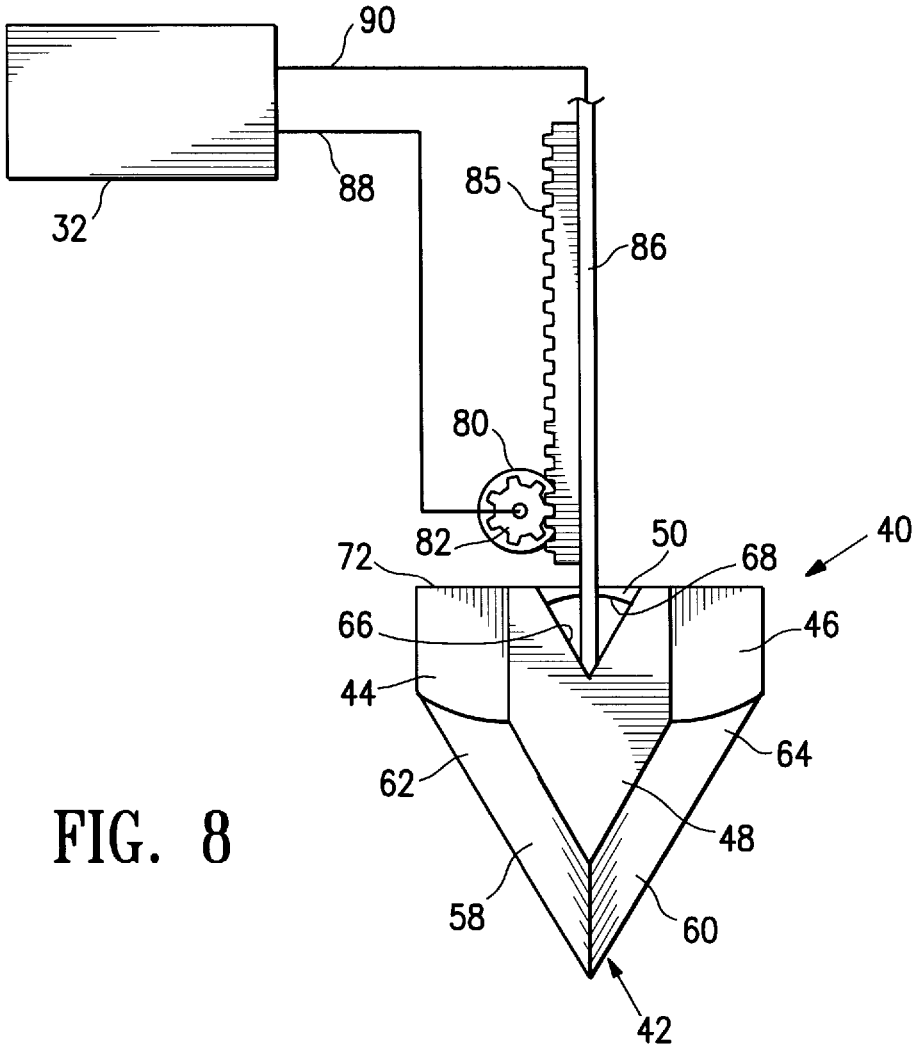
FIG. 8 is a diagrammatic front elevational view of the housing of FIG. 5 plus elements to raise and lower the housing.

The advantages of economy, unobtrusiveness, ease of use and reliability may now be appreciated from reference to FIGS. 4 and 8. In FIG. 4, there is illustrated a cut-away view of the bow of the fishing boat showing the trolling motor housing 40 in its retracted position in solid line and in its extended position in phantom line. Because the trolling motor and its shafts are located internally in the boat, they are shorter and thereby stronger than would be the case of a trolling motor which is attached to the outer bow of a boat using a bracket. Such motors require relatively long shafts and are less strong and more susceptible to damage.

Figure 7:
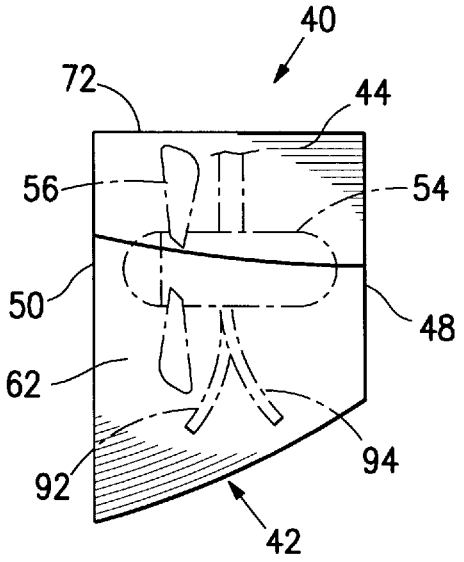
FIG. 7 is a side elevational view of the trolling motor housing shown in FIG. 5.

Referring now to FIGS. 4, 7 and 8, the mechanism for raising and lowering the trolling motor housing may be a D-C motor and gear combination 80 where the gear terminates in a pinion 82 that engages and moves a rack 84 fastened to a support post 86 upwardly and downwardly. Power to operate the DC motor and the trolling motor may be derived from the battery 32. Suitable wires 88 connect the battery with the DC motor whereas another group of wires 90 connect the battery with the trolling motor. It should be understood that any other suitable means could be used to raise and lower the trolling motor. For example, a worm gear arrangement may be used, or a belt drive or a cable system would all appear to be equivalent mechanisms. As seen in FIG. 4, connected at the upper end of the post 86 is the steering disc 30 which may be operated by hand or, more conveniently, by a fishing person's foot to rotate the steering disc, the post and the housing through a full 360 degrees.

The trolling motor may be suspended from the support post 86, and mounting brackets, such as the two brackets 92 and 94, FIG. 7, may be provided to support the housing and directly connect it to the trolling motor. When the housing is extended, it acts to not only protect the propeller from weeds and debris, but also to make it less likely that a fishing line will get entangled with the propeller.

Figure 9:
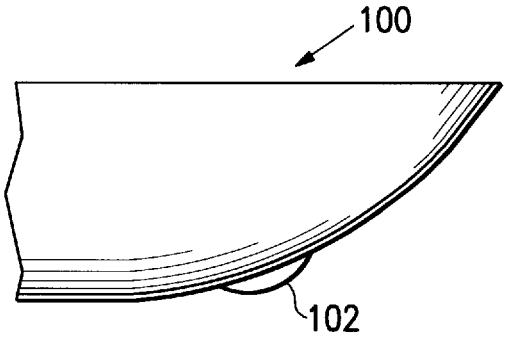
FIG. 9 is a partial side elevational view of a boat with another embodiment of the trolling motor housing of the present invention.

Referring now to FIG. 9, there is illustrated another embodiment of a trolling motor housing of the present invention. There is shown a fishing boat 100 to which is mounted a trolling motor housing having a dome shape bottom wall 102. A dome shape design allows for the installation of a larger trolling motor, and yet the housing will still minimize the interference of the trolling motor with the performance of the boat.

In operation, the power boat 10 is used in a typical manner between the dock and a fishing area. Under these conditions the boat is operating under the power of the outboard engine 15. Typically, during cruise, the bow raises up out of the water. This allows the boat to move at considerable velocity. An operator will usually be positioned at the helm standing on the deck 18 or sitting in the chair 20. When a fishing area is reached, the operator transfers to the fore pedestal seat 21 or he may stand on the floor casting deck 17. In either position he is able to manipulate the disc 30 with his/her foot. Thus, a push button on the disc may be actuated to lower the trolling motor housing, and the disc may be rotate causing the housing and motor to rotate through a 360 degree angle. This allows for fine adjustments in the position of the boat. The entire procedure is extremely easy and reliable while the actual hardware of the housing, the steering disc, the mechanism for moving the housing upwardly and downwardly is all very simple, economical and reliable.

The specification describes in detail several embodiments of the present invention. Other modifications and variations will, under the doctrine of equivalents, come within the scope of the appended claims. For example, numerous different mechanisms may be used to raise and lower the trolling motor and housing. The housing may include different shapes, especially the bottom wall, as a function of the shape of the hull in boat in which the housing is mounted. The sizes of the openings in the front and the rear walls may vary as may the size of the trolling motor. The foregoing are all considered equivalent structures or variations. Still other alternatives will also be equivalent as will many new technologies. There is no desire or intention here to limit in any way the application of the doctrine of equivalents.

I claim:

1. A retractable housing apparatus for a boat trolling motor comprising:

a bottom wall with a streamline surface;

first and second generally vertical side walls connected to said bottom wall;

an upstream opening formed in said apparatus for the passage of water in which the boat having the apparatus is floating;

a downstream opening formed in said apparatus for the passage of water which enters through said upstream opening; and a chamber formed above said bottom wall and between said side walls for receiving a trolling motor.

2. An apparatus as claimed in claim 1 including:

a front wall connected to said bottom and side walls and having said upstream opening formed therein; and a rear wall connected to said bottom and side walls and having said downstream opening formed therein.

3. An apparatus as claimed in claim 2 wherein:

said bottom wall includes two portions conforming to the hull of the boat having the apparatus.

4. An apparatus as claimed in claim 3 wherein:

said two portions have a generally V-shaped configuration in cross-section.

5. An apparatus as claimed in claim 2 wherein:

said bottom, side, front and rear walls are movable between two positions, a retracted position wherein said streamline surface is generally aligned with the adjacent surface or surfaces of the hull of the boat in which the apparatus is mounted and said trolling motor is in a stored position, and an extended position wherein said bottom, side, front and rear walls are located beneath the hull of the boat in which the apparatus is mounted and said trolling motor is in an operative mode.

6. An apparatus as claimed in claim 5 wherein:

said bottom, side, front and rear walls are rotatable through 360 degrees when in said extended position.

7. An apparatus as claimed in claim 6 wherein:

said streamline surface of said bottom wall is a continuation of a surface or surfaces of the bottom of said boat in which said apparatus is mounted.

8. An apparatus as claimed in claim 2 wherein:

said streamline surface of said bottom wall is dome shaped.

9. An apparatus as claimed in claim 2 including:

means connected to said walls and mounted to said boat for raising and lowering said walls and said trolling motor.

10. An apparatus as claimed in claim 9 wherein:

said streamline surface of said bottom wall is a continuation of a surface or surfaces of the bottom of said boat in which said apparatus is mounted.

11. A boat with a housing for mounting a trolling motor comprising:

a bottom wall with a streamline surface;

first and second side walls connected to said bottom wall;

a front wall connected to said bottom and side walls, said front wall having an opening for the passage of water;

a rear wall connected to said bottom and side walls having an opening for the passage of water which enters through said opening in said front wall; and wherein said bottom, side, front and rear walls are movable between two position, a retracted position wherein said bottom surface is generally aligned with the adjacent surface or surfaces of the hull of the boat in which said walls are mounted and said trolling motor is in a stored position, and an extended position wherein said walls are located beneath the hull of the boat in which the walls are mounted, and said trolling motor is in an operative mode; and a recess in said boat for forming a pocket to receive said walls when said walls are in said retracted position.

12. An apparatus as claimed in claim 11 wherein:

said recess is water sealed.

13. A trolling motor apparatus for use with a boat comprising in combination:

a boat having a hull with a bottom surface;

a main motor mounted to said boat for powering said boat;

a trolling motor mounted to said boat;

a housing formed around said trolling motor, said housing including a bottom surface;

means connected to said housing and said boat for moving said housing between upward and downward positions relative to said hull;

an electrical energy source mounted to said boat;

means connected to said energy source and to said trolling motor for transmitting power to said trolling motor;

means connected to said energy source and said moving means for transmitting power to said moving means;

means connected to said trolling motor for steering said boat;

a recess formed in the bottom of said boat to receive said housing;

said housing including a bottom wall with a streamline surface;

first and second sidewalls connected to said bottom wall;

a front wall having an opening for the passage of water connected to said bottom and side walls; and a rear wall having an opening for the passage of water connected to said bottom and side walls.

14. An apparatus as claimed in claim 13 wherein:

said housing is rotatable through 360 degrees when in a downward position.

* * * * *